US011851870B2

(12) United States Patent
Lee

(10) Patent No.: US 11,851,870 B2
(45) Date of Patent: Dec. 26, 2023

(54) COMBINATION STRUCTURE OF PERMANENT FORM AND PREFABRICATED STEEL ASSEMBLY FOR STEEL CONCRETE COMPOSITE MEMBER

(71) Applicant: SENVEX CO., LTD., Seoul (KR)

(72) Inventor: Chang Nam Lee, Seoul (KR)

(73) Assignee: SENVEX CO., LTD., Seoul (KR)

( * ) Notice: Subject to any disclaimer, the term of this patent is extended or adjusted under 35 U.S.C. 154(b) by 376 days.

(21) Appl. No.: 17/418,850

(22) PCT Filed: Mar. 25, 2020

(86) PCT No.: PCT/KR2020/004048

§ 371 (c)(1),
(2) Date: Jun. 28, 2021

(87) PCT Pub. No.: WO2020/231003

PCT Pub. Date: Nov. 19, 2020

(65) Prior Publication Data

US 2022/0074190 A1 Mar. 10, 2022

(30) Foreign Application Priority Data

May 13, 2019 (KR) ..... 10-2019-0055862

(51) Int. Cl.
*E04B 1/16* (2006.01)
*E04B 1/30* (2006.01)
*E04C 3/34* (2006.01)

(52) U.S. Cl.
CPC ..... *E04B 1/167* (2013.01); *E04B 1/165* (2013.01); *E04B 1/30* (2013.01); *E04C 3/34* (2013.01)

(58) Field of Classification Search
CPC . E04B 1/167; E04B 1/165; E04B 1/30; E04C 3/34; E04C 3/293; E04C 3/36
See application file for complete search history.

(56) References Cited

U.S. PATENT DOCUMENTS 1,914,065 A * 6/1933 Bauer ..... E04C 3/34 52/649.6
4,604,250 A * 8/1986 Ecker ..... E04G 13/02 249/90

(Continued)

FOREIGN PATENT DOCUMENTS

JP 2012-140825 A 7/2012
KR 10-2011-0115697 A 10/2011

(Continued)

OTHER PUBLICATIONS

International Search Report for PCT/KR2020/004048 dated Jun. 30, 2020 from Korean Intellectual Property Office.
Extended European Search Report of 20806875 dated Sep. 1, 2023.

*Primary Examiner* — Rodney Mintz
(74) *Attorney, Agent, or Firm* — Revolution IP, PLLC

(57) ABSTRACT

The present invention relates to a combination structure of permanent forms and a prefabricated steel assembly for a steel concrete composite member, the combination structure including: the prefabricated steel assembly having a plurality of shape steel members and a plurality of support bars; and each permanent form having a flat plate, 'L'-shaped protrusions, a bent corner, and a 'L'-shaped outer protrusion.

3 Claims, 9 Drawing Sheets

(56) References Cited

U.S. PATENT DOCUMENTS

| | | | | |
|---|---|---|---|---|
| 6,295,770 | B1 * | 10/2001 | Sheu | E04C 5/04 52/649.3 |
| 7,665,259 | B2 * | 2/2010 | Yoon | E04C 3/34 52/252 |
| 8,640,419 | B2 * | 2/2014 | Lee | E04C 5/0645 52/649.2 |
| 9,856,647 | B1 * | 1/2018 | Kim | E04C 3/34 |
| 10,301,838 | B1 * | 5/2019 | Karakas | E04C 5/0609 |
| 2005/0097854 | A1 * | 5/2005 | Tu | E04C 3/34 52/698 |
| 2006/0117704 | A1 * | 6/2006 | Yoon | E04C 3/34 52/834 |
| 2009/0282753 | A1 * | 11/2009 | Kuan | E04C 5/0636 52/167.1 |
| 2010/0287878 | A1 * | 11/2010 | Lee | E04C 3/293 52/847 |
| 2012/0210669 | A1 * | 8/2012 | Lee | E04C 5/0645 52/745.19 |
| 2013/0133278 | A1 * | 5/2013 | Kim | E04C 3/34 52/223.4 |

FOREIGN PATENT DOCUMENTS

| | | | |
|---|---|---|---|
| KR | 10-2012-0121628 | A | 11/2012 |
| KR | 10-1490748 | B1 | 2/2015 |
| KR | 10-2015-0137181 | A | 12/2015 |
| KR | 10-1584008 | B1 | 1/2016 |
| KR | 10-1618798 | B1 | 5/2016 |
| KR | 10-2018-0079748 | A | 7/2018 |
| WO | 2019/074283 | A1 | 4/2019 |

* cited by examiner

【FIG.1】
- Prior Art -
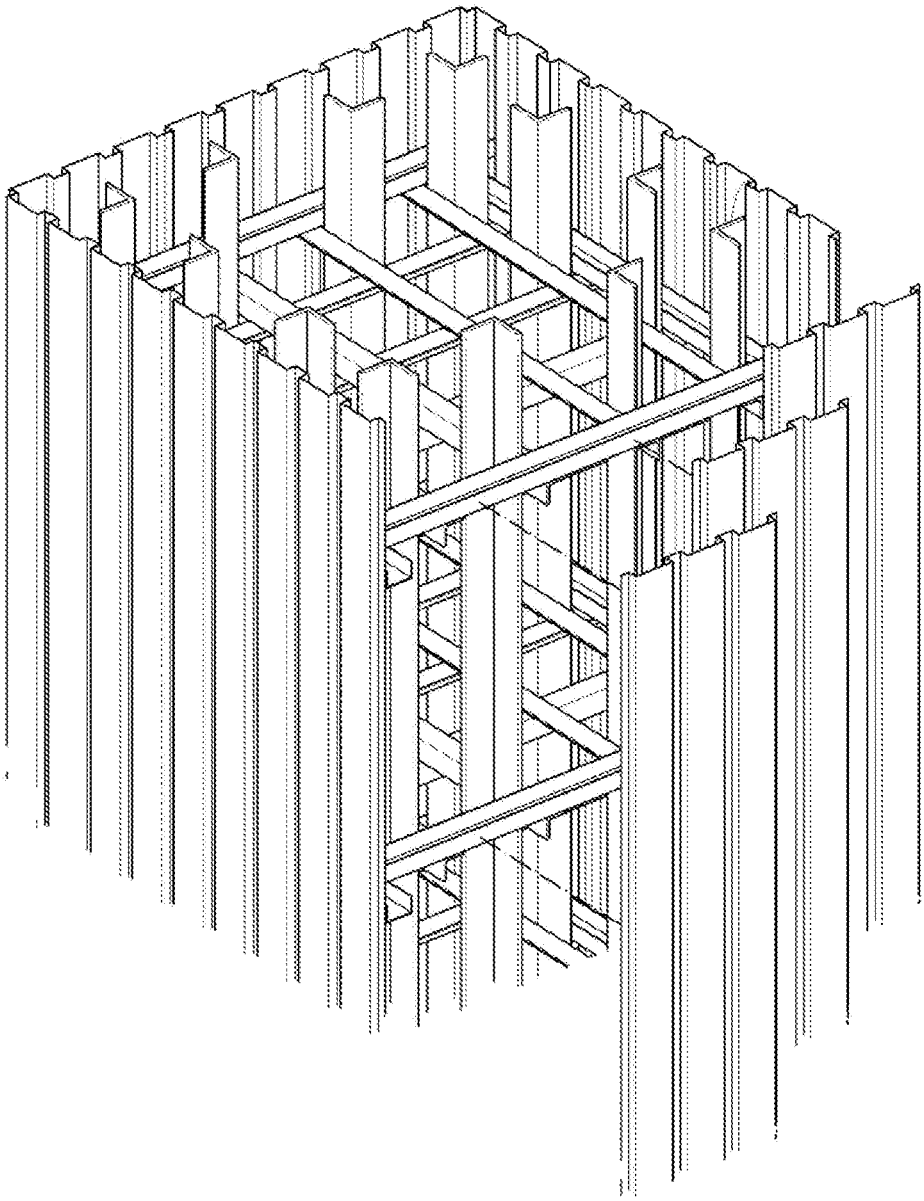

【FIG.2】
- Prior Art -
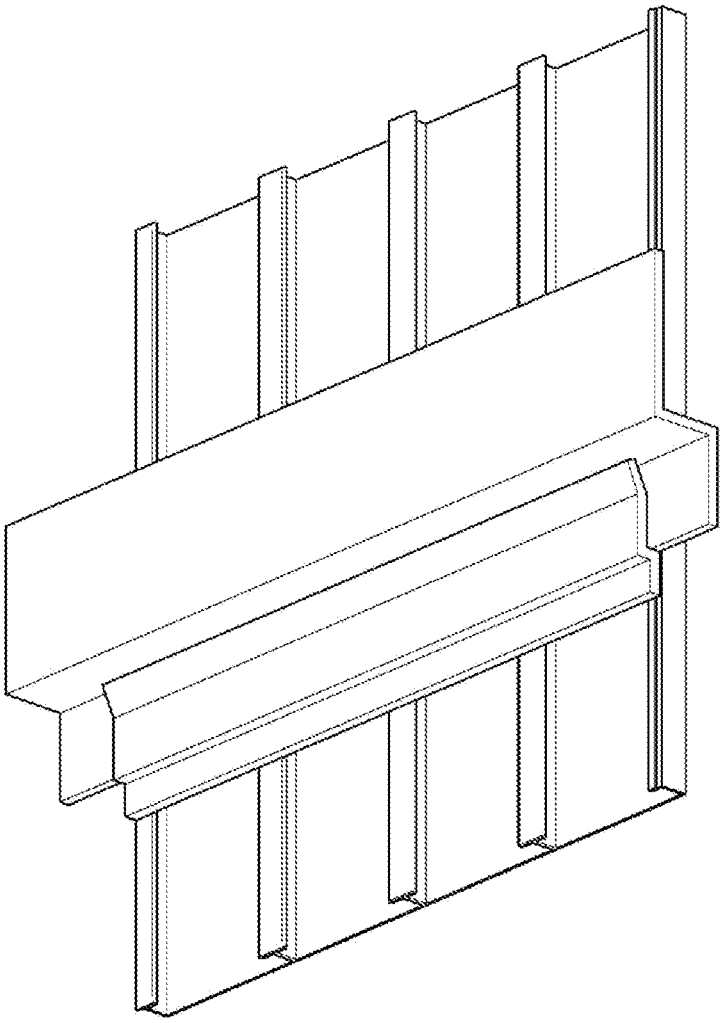

【FIG.3】
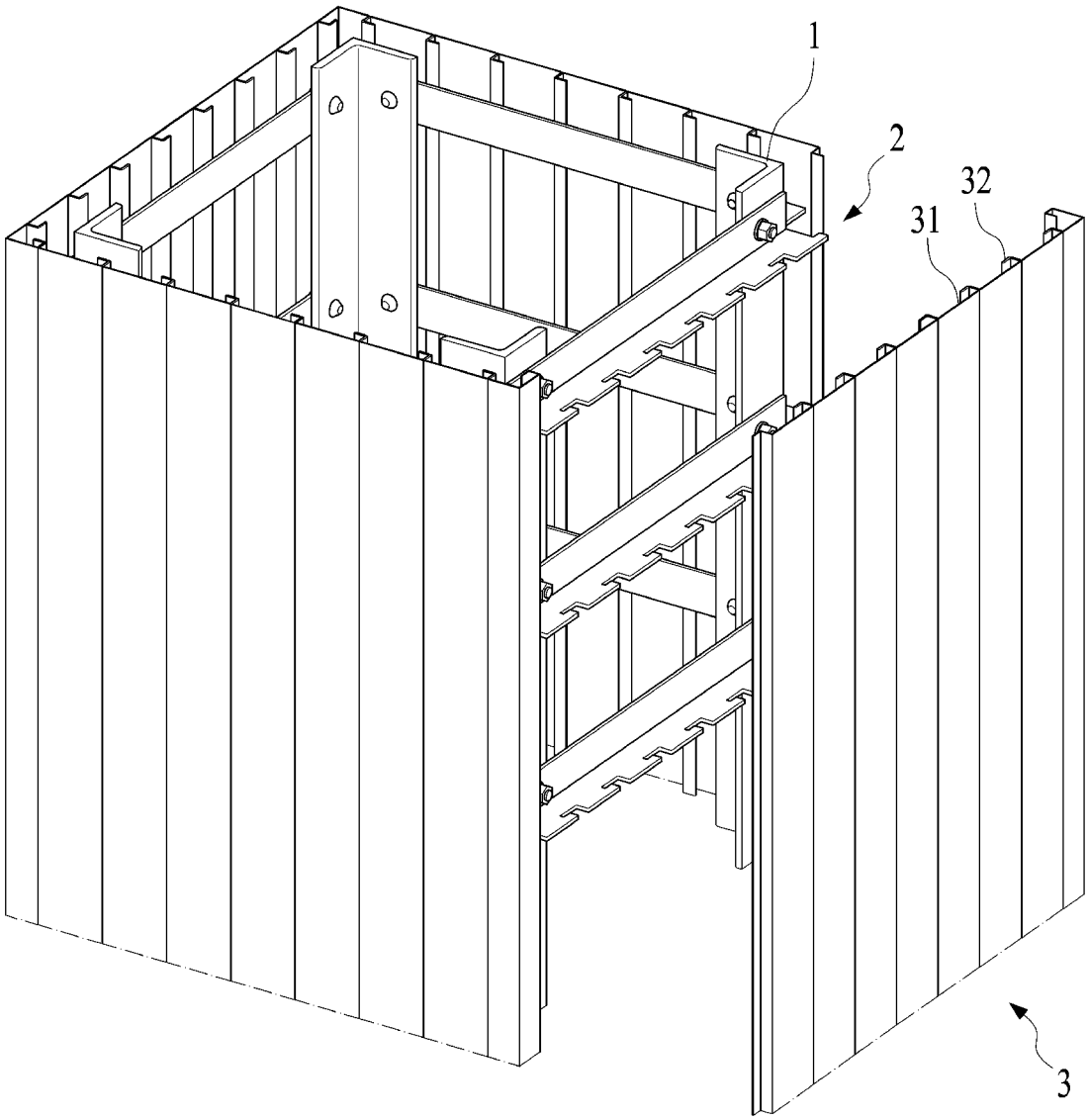

【FIG.4】
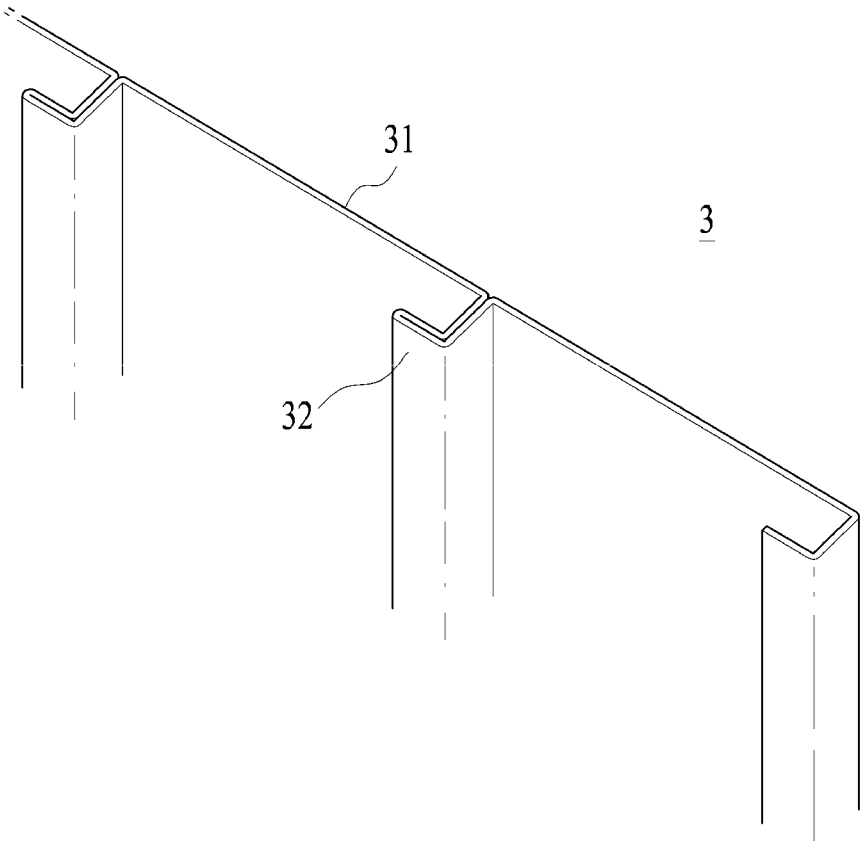
【FIG.5】
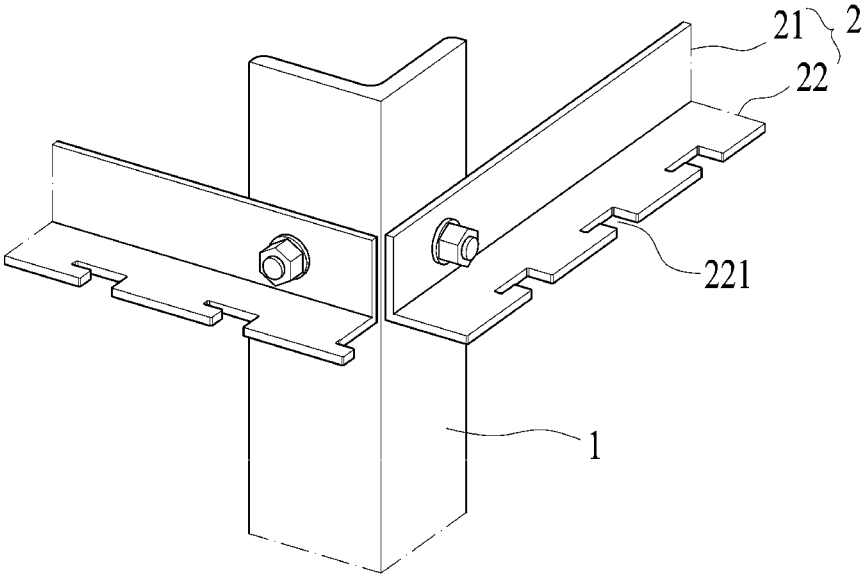

【FIG.6】
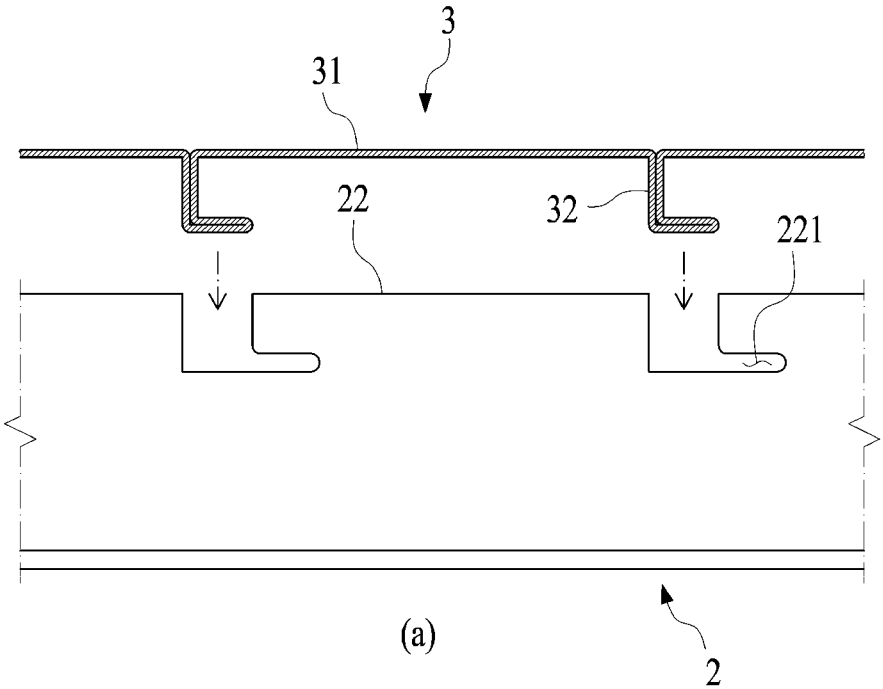
(a)
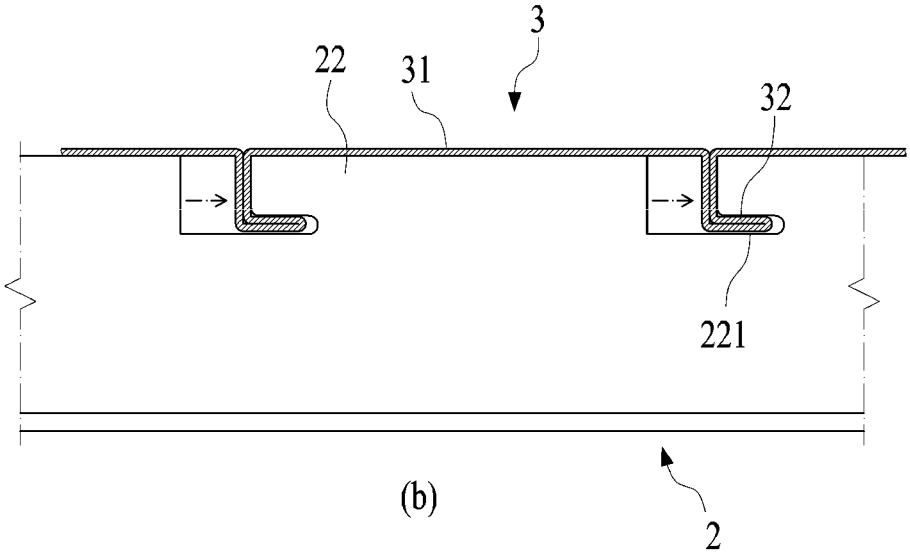
(b)

【FIG.7】
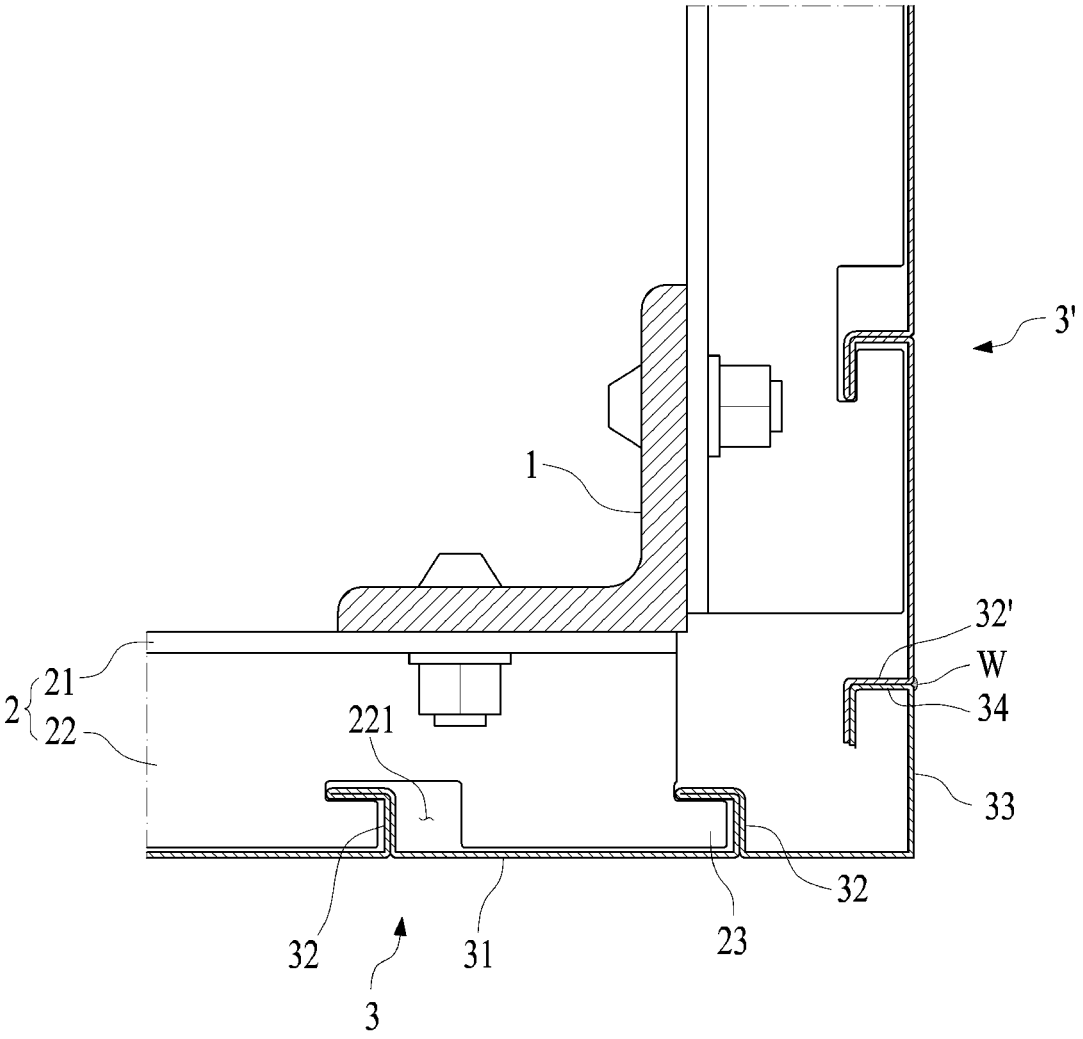

【FIG.8】
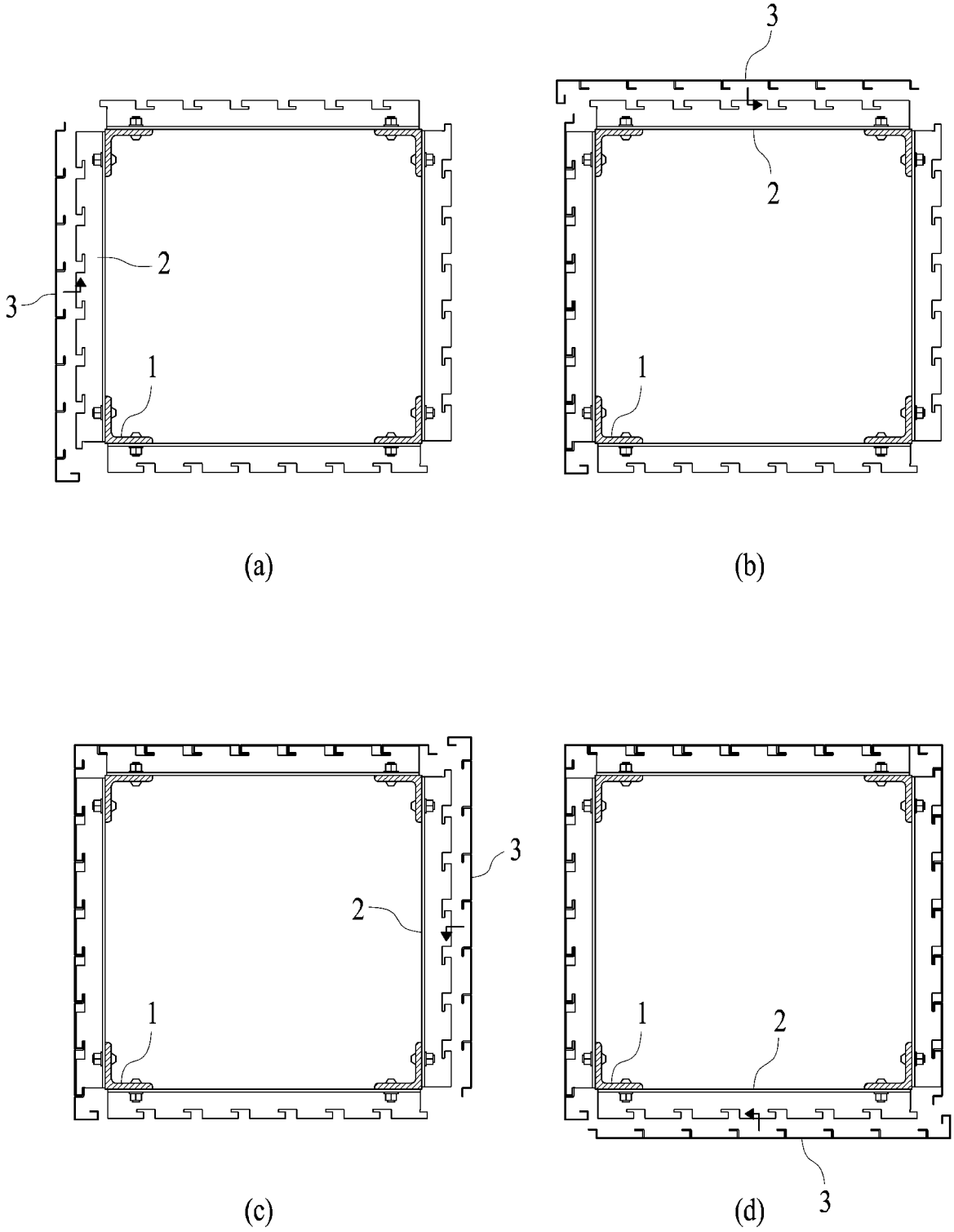

【FIG.9】
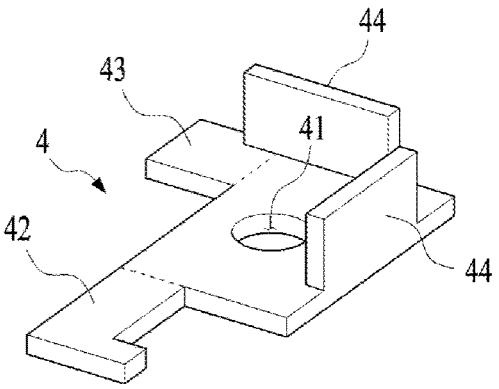
【FIG.10】
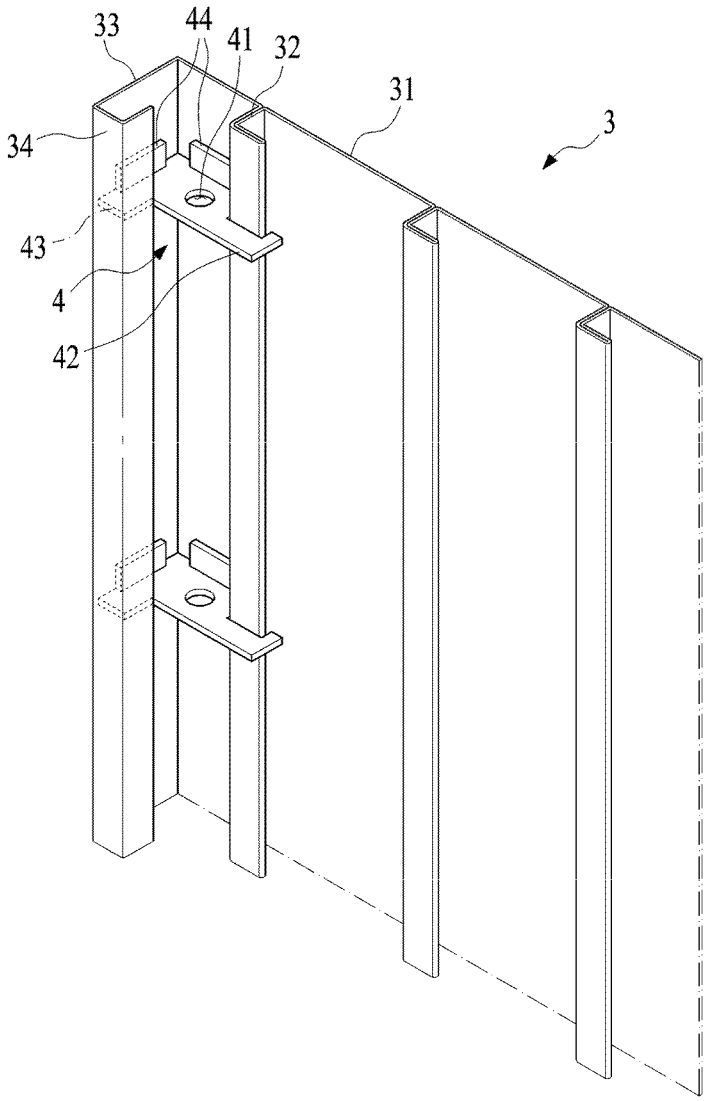

【FIG.11】
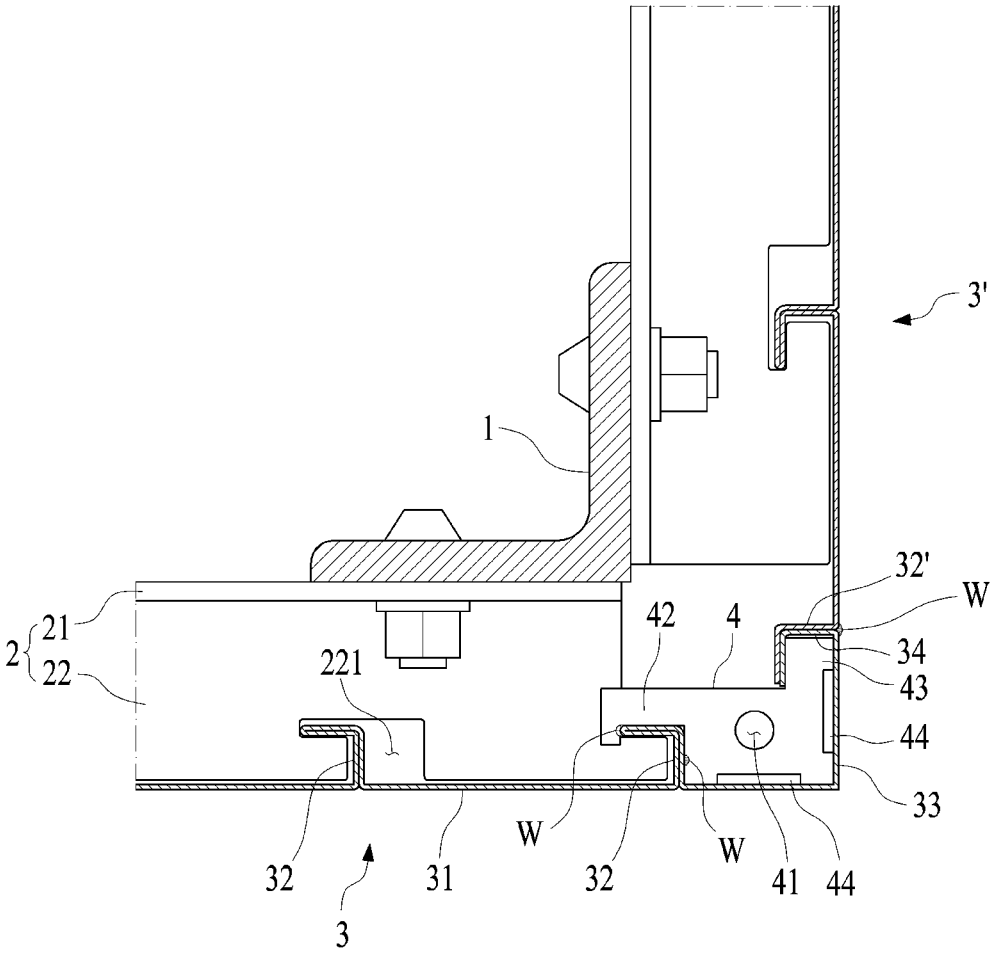

COMBINATION STRUCTURE OF PERMANENT FORM AND PREFABRICATED STEEL ASSEMBLY FOR STEEL CONCRETE COMPOSITE MEMBER

TECHNICAL FIELD

The present invention relates to a combination structure of permanent forms and a prefabricated steel assembly for a steel concrete composite member that is capable of easily combining the permanent forms with the prefabricated steel assembly, irrespective of positions of support bars connecting shape steel members of the prefabricated steel assembly.

BACKGROUND ART

A form is a structure temporarily installed to build concrete having fluidity to a given shape and a given size during a short period of time in which the concrete is cured to some degree, and formwork is necessarily needed in a concrete structure like a reinforced concrete structure, a steel framed reinforced concrete structure, and so on.

Basically, the form includes a form panel for forming a concrete surface and support frames for supporting the form panel to maintain stiffness of the form, and during the formwork, further, temporary supports are needed to support the form.

Accordingly, a great number of materials for the formwork are required, and in addition, a lot of time and cost for assembling and disassembling forms or supports have been consumed.

In case of a big-sized structure, particularly, works for installing or removing temporary materials are carried out at high altitudes, so that there is a big possibility that safety accidents of workers may occur, and further, a construction cost may increase due to lots of temporary materials.

In the conventional formwork, also, a release agent is applied to the panel surface of the form to remove the form from concrete, thereby undesirably causing environmental pollution.

After the removal of the form, in addition, separate concrete surface grinding has to be inconveniently carried out.

So as to solve the problems occurring in the conventional formwork, as shown in FIG. 1, a conventional technology relates to a prefabricated column frame with rib deck forms (which is disclosed in Korean Patent No. 10-1490748). According to the conventional practice, the forms are fastened to horizontal support members having high stiffness by means of self drilling screws and are then coupled to the prefabricated column frame, so that advantageously, no temporary supports are needed and a thickness of a form panel can be minimized.

However, the positions of the horizontal support members for coupling the forms should be accurately recognized, and also, the self drilling screws have to be fastened one by one, thereby undesirably requiring lots of time for attaching the forms to the horizontal support members. Besides, concrete paste may leak from portions of the self drilling screws to the outside.

Another conventional technology as shown in FIG. 2 relates to a deck form fixing structure for slidingly moving a deck form to an upper side from a lower side thereof to couple the deck form to a prefabricated frame (which is disclosed in Korean Patent No. 10-1618798). According to the conventional practice, advantageously, the form can be easily coupled to the prefabricated frame, irrespective of the positions of fixing bars, and form installation time can be greatly reduced because no self drilling screws exist.

However, the deck form has to be moved to the upper side of a member from the lower side thereof, thereby needing a spare space for building the deck form on the lowermost portion of the member. Accordingly, the lower portion of the member should be finished inconveniently with a separate form. Besides, positions of first fixing bars as horizontal support members have to accurately correspond to positions of second fixing bars coupled to the deck form, thereby requiring high accuracy in making the member.

DISCLOSURE

Technical Problem

Accordingly, the present invention has been made in view of the above-mentioned problems occurring in the prior art, and it is an object of the present invention to provide a combination structure of permanent forms and a prefabricated steel assembly for a steel concrete composite member that is capable of easily combining the permanent forms with the prefabricated steel assembly, irrespective of positions of support bars connecting shape steel members of the prefabricated steel assembly.

Technical Solution

To accomplish the above-mentioned object, according to the present invention, there is provided a combination structure of permanent forms and a prefabricated steel assembly for a steel concrete composite member, the combination structure including: the prefabricated steel assembly adapted to build the steel concrete composite member and having a plurality of shape steel members disposed on corners of the steel concrete composite member in such a manner as to be internally spaced apart from the steel concrete composite member and a plurality of support bars coupled to outer surfaces of the shape steel members to connect the neighboring shape steel members, each support bar having a 'L'-shaped section to allow one side leg to be fixedly coupled to the shape steel members; and each permanent form having a flat plate adapted to build an outer surface of the steel concrete composite member, protrusions having 'L'-shaped sections in such a manner as to protrude longitudinally from the inner surface of the flat plate, a bent corner portion bent vertically from one side end of the flat plate toward the neighboring member surface, and an outer protrusion having a 'L'-shaped section, protruding longitudinally from the inner end of the bent corner portion, and laid on top of a protrusion formed on an outermost position of the permanent form coupled to the neighboring member surface, wherein each support bar has the other side leg having 'L'-shaped locking holes whose inlets are larger than widths of the protrusions so as to insertedly lock the protrusions thereinto.

According to the present invention, desirably, the other side leg of each support bar has an extended support extended from one end thereof toward the bent corner portion in such a manner as to be inserted into the inside of the corresponding protrusion so as to support the corresponding protrusion.

According to the present invention, desirably, corner stiffeners are coupled to the inside of the bent corner portion.

According to the present invention, desirably, each corner stiffener has a first extended portion extended from a protrusion side end portion thereof in such a manner as to surround the protrusion and a second extended portion extended from an outer protrusion side end portion thereof in such a manner as to be inserted into the inside of the outer protrusion.

According to the present invention, desirably, each corner stiffener has support wings bent vertically from sides coming into contact with the bent corner portion in such a manner as to be supported against the surfaces of the bent corner portion.

Advantageous Effects

According to the present invention, the combination structure has the following advantages.

Firstly, the permanent forms are coupled to the prefabricated steel assembly, thereby greatly reducing time and costs required to construct and deconstruct the forms.

Secondly, the permanent forms are supported against the shape steel members by means of the support bars located inside the member, thereby requiring no separate temporary supports for supporting the permanent forms.

Thirdly, the support bars serve as the support frames for the permanent forms, so that thicknesses of the forms can be minimized, which gives an economical advantage, and further, the permanent forms can be more lightweight than the existing forms, thereby being easily handled by a worker.

Fourthly, the protrusions formed in the longitudinal direction of the member on the inner surface of the permanent form are inserted into the locking holes of the support bars of the prefabricated steel assembly, and next, the permanent form is slidingly moved in the transverse direction of the member and is thus locked onto the locking holes of the support bars, so that the permanent form can be rapidly and easily coupled to the prefabricated steel assembly, irrespective of the positions of the support bars, and moreover, there is no need to form any spare space on the end portion of the member to insert the permanent form.

Lastly, the bent corner portion is extended unitarily from the permanent form of the member surface on the corner of the member, and the bonding portion of the permanent form to the neighboring permanent form is moved to the member surface, so that the permanent form can be stably resistant to the lateral pressure on the corner thereof.

DESCRIPTION OF DRAWINGS

FIG. 1 is a perspective view showing a conventional prefabricated column with rib deck forms.

FIG. 2 is a sectional view showing a form moved to an upper portion of a prefabricated frame structure and thus coupled thereto in another conventional practice.

FIG. 3 is a perspective view showing a coupling relation between a prefabricated steel assembly and a permanent form according to the present invention.

FIG. 4 is a perspective view showing the permanent form of a combination structure according to the present invention.

FIG. 5 is a perspective view showing support bars of the combination structure according to the present invention.

FIG. 6 shows plan views (A) and (B) illustrating coupling processes of the permanent form to the support bar of FIG. 5.

FIG. 7 is a plan view showing a coupled state of the permanent form to the neighboring permanent form on a corner of a member in the combination structure according to the present invention.

FIG. 8 shows sectional views (A) to (D) illustrating coupling processes of the permanent forms to the surfaces of the member in the combination structure according to the present invention.

FIG. 9 is a perspective view showing a corner stiffener of the combination structure according to the present invention.

FIG. 10 is a perspective view showing the permanent form to which the corner stiffeners are coupled in the combination structure according to the present invention.

FIG. 11 is a plan view showing an example where the corner stiffener is adopted in the combination structure according to the present invention.

BEST MODE FOR INVENTION

To accomplish the above-mentioned object, according to the present invention, there is provided a combination structure of permanent forms and a prefabricated steel assembly for a steel concrete composite member, the combination structure including: the prefabricated steel assembly adapted to build the steel concrete composite member and having a plurality of shape steel members disposed on corners of the steel concrete composite member in such a manner as to be internally spaced apart from the steel concrete composite member and a plurality of support bars coupled to outer surfaces of the shape steel members to connect the neighboring shape steel members, each support bar having a 'L'-shaped section to allow one side leg to be fixedly coupled to the shape steel members; and each permanent form having a flat plate adapted to build an outer surface of the steel concrete composite member, protrusions having 'L'-shaped sections in such a manner as to protrude longitudinally from the inner surface of the flat plate, a bent corner portion bent vertically from one side end of the flat plate toward the neighboring member surface, and an outer protrusion having a 'L'-shaped section, protruding longitudinally from the inner end of the bent corner portion, and laid on top of a protrusion formed on an outermost position of the permanent form coupled to the neighboring member surface, wherein each support bar has the other side leg having 'L'-shaped locking holes whose inlets are larger than widths of the protrusions so as to insertedly lock the protrusions thereinto.

MODE FOR INVENTION

Hereinafter, the present invention will be in detail explained with reference to the attached drawing.

FIG. 3 is a perspective view showing a coupling relationship between a prefabricated steel assembly and a permanent form according to the present invention, FIG. 4 is a perspective view showing the permanent form of the combination structure according to the present invention, FIG. 5 is a perspective view showing support bars of the combination structure according to the present invention, FIGS. 6A and 6B are plan views showing coupling processes of the permanent form to the support bar of FIG. 5, and FIG. 7 is a plan view showing a coupled state of the permanent form to the neighboring permanent form on a corner of a member in the combination structure according to the present invention.

As shown in FIGS. 3 to 7, the present invention relates to a combination structure of permanent forms and a prefabricated steel assembly for a steel concrete composite member, which couples the permanent forms 3 to the prefabricated steel assembly, and the prefabricated steel assembly, which is adapted to build the steel concrete composite member, includes a plurality of shape steel members 1 disposed on corners of the steel concrete composite member in such a manner as to be internally spaced apart from surfaces of the steel concrete composite member and a plurality of support bars 2 coupled to outer surfaces of the shape steel members 1 to connect the neighboring shape steel members 1, each support bar 2 having a 'L'-shaped section in such a manner as to allow one side leg 21 thereof to be fixedly coupled to the shape steel members 1.

According to the present invention, each permanent form 3 includes a flat plate 31 adapted to build an outer surface of the steel concrete composite member, protrusions 32 having 'L'-shaped sections in such a manner as to protrude longitudinally from the inner surface of the flat plate 31, a bent corner portion 33 bent vertically from one side end of the flat plate 31 toward the neighboring member surface, and an outer protrusion 34 having a 'L'-shaped section, protruding longitudinally from the inner end of the bent corner portion 33, and laid on top of a protrusion 32' formed on an outermost position of a permanent form 3' coupled to the neighboring member surface, and each support bar 2 has the other side leg 22 having 'L'-shaped locking holes 221 whose inlets are larger than widths of the protrusions 32 so as to insertedly lock the protrusions 32 thereinto.

The prefabricated steel assembly can be in advance made in a factory so as to build the steel concrete composite member like a column, a girder and so on.

The prefabricated steel assembly includes the shape steel members 1 disposed on corners of the steel concrete composite member in such a manner as to be internally spaced apart from the surfaces of the steel concrete composite member and the support bars 2 coupled transversely to outer surfaces of the shape steel members 1 to transversely connect the neighboring shape steel members 1.

The support bars 2 are directly coupled to the permanent form 3 and are spaced apart from each other in a longitudinal direction of the member.

Each support bar 2 has a 'L'-shaped section and includes one side leg 21 fixed to the shape steel members 1 by means of rivets, bolts, welding, and so on and the other side leg 22 located toward the outside of the member.

The other side leg 22 of the support bar 2 has the 'L'-shaped locking holes 221 formed on the outer end thereof.

The locking holes 221 are portions where the 'L'-shaped protrusions 32 of the permanent form 3 are locked.

The locking holes 221 are spaced apart from each other in a longitudinal direction of the support bar 2, that is, in a transverse direction of the member.

In some cases, a Z-shaped steel member, a C-shaped steel member, or a lightweight steel frame may be used as the support bar 2.

As shown in FIG. 4, the permanent form 3 includes the flat plate 31 adapted to build an outer surface of the steel concrete composite member and the protrusions 32 having 'L'-shaped sections in such a manner as to protrude longitudinally from the inner surface of the flat plate 31.

As shown in FIG. 7, further, the permanent form 3 includes the bent corner portion 33 bent vertically from one side end of the flat plate 31 toward the neighboring member surface, and the protrusions 32 is formed on the other side end portion of the flat plate 31.

Furthermore, the permanent form 3 includes the outer protrusion 34 having a 'L'-shaped section, protruding longitudinally from the inner end of the bent corner portion 33, and laid on top of the protrusion 32' formed on the outermost position (the other side end portion) of the permanent form 3' coupled to the neighboring member surface.

The protrusions 32 may be spaced apart in a plurality of columns from each other along the transverse direction of the member, like the locking holes 221 of the other side leg 22 of the support bar 2.

Since stiffness of a section of the member increases through an I value raised by the formation of the protrusions 32, the permanent form 3 can ensure excellent resistance for a lateral pressure upon concrete casting.

The protrusions 32 are buried in concrete after the concrete casting so that they become integral with the concrete.

The protrusions 32 are inserted into the locking holes 221 of the support bars 2 to allow the permanent form 3 to be fixed to the support bars 2.

Upon concrete casting, generally, a lateral pressure of the concrete is intensively generated from the corners of the member. According to the present invention, therefore, the bent corner portion 33 is extended unitarily from the permanent form 3 of the member surface on the corner of the member, and a bonding portion of the permanent form 3 to the neighboring permanent form 3' is moved to the member surface, so that the permanent form 3 can be stably resistant to the lateral pressure on the corner thereof.

The outer protrusion 34 has the 'L'-shaped section in such a manner as to be laid on top of the other side outermost protrusion 32' of the permanent form 3' coupled to the neighboring member surface.

As shown in FIG. 7, flare welding W is carried out with a designed welding length on a portion where the outer protrusion 34 is laid on top of the other side outermost protrusion 32' of the permanent form 3' coupled to the neighboring member surface, so that the protrusion 34 and the other side outermost protrusion 32' can be fixed to each other. Accordingly, a bonded portion can be prevented from being open due to a concrete casting pressure in the transverse direction of the member.

The permanent form 3 is formed of one flat plate which is bent unitarily to the flat plate 31, the protrusions 32, the bent corner portion 33 and the outer protrusion 34.

The permanent form 3 may be in advance attached to the support bars 2 coupled to the shape steel members 1, and otherwise, it can be attached thereto in a construction site.

If the member has a large width, the permanent form 3 is segmented into a plurality of forms, and the plurality of permanent forms 3 can be coupled to one surface of the member.

As shown in FIGS. 6A and 6B, the inlets of the locking holes 221 are larger than the widths of the protrusions 32.

Accordingly, the protrusions 32 can be inserted directly into the front surfaces of the support bars 2, thereby allowing the permanent form 3 to be coupled directly to the front surface of the member.

In detail, the permanent form 3 comes into close contact with the front surfaces of the support bars 2 so as to insert the protrusions 32 into the locking holes 221, and next, the permanent form 3 is slidingly moved in a horizontal direction, so that the protrusions 32 can be easily locked onto the locking holes 221.

Moreover, the corner of the member is built by means of the bent corner portion 33 extended from the flat plate 31, and the outer protrusion 34 formed on the end portion of the bent corner portion 33 has a corresponding shape to the other side outermost protrusion 32' of the permanent form 3' coupled to the neighboring member surface, so that it is laid on top of the other side outermost protrusion 32'.

So as to prevent the permanent form 3 after installed from sliding in the longitudinal direction of the member, the support bars 2 and the permanent form 3 can be welded to each other on one or more positions per one.

As mentioned above, after the protrusions 32 of the permanent form 3 are inserted into the locking holes 221 on the front surface of the member, the permanent form 3 is slidingly moved in the transverse direction of the member, so that the protrusions 32 can be locked onto the locking holes 221. Accordingly, there is no need to form any spare space on the end portion of the member to insert the permanent form 3, and the permanent form 3 having the 'L'-shaped protrusions 32 can be used over the whole surface of the member.

Moreover, the permanent form 3 is supported against the shape steel members 1 through the support bars 2 located inside the member, so that no separate temporary supports for supporting the permanent form are required.

Also, the support bars 2 serve as support frames for the permanent form, so that a thickness of the permanent form can be minimized, which gives an economical advantage. Further, the permanent form can be more lightweight than the existing form, thereby being easily handled by a worker.

As shown in FIG. 7, an extended support 23 is extended from one end of the other side leg 22 toward the bent corner portion 33 in such a manner as to be inserted into the inside of the protrusion 32 so as to support the protrusion 32.

If the extended support 23 extended from one end of the other side leg 22 of the support bar 2 is inserted into the inside of the protrusion 32 of the permanent form 3 to support the protrusion 32, the permanent form 3 can be prevented from being deformed outward due to the lateral pressure of the concrete on the corner of the member.

FIGS. 8A to 8D are sectional views showing coupling processes of the permanent forms to the surfaces of the member.

Now, the coupling processes of the permanent forms 3 to the surfaces of the member will be explained with reference to FIGS. 8A to 8D.

First, as shown in FIG. 8A, the 'L'-shaped locking holes 221 are formed on the other side leg 22 of the support bars 2, and accordingly, the permanent form 3 comes into close contact with the support bars 2 on one surface of the member, so that the protrusions 32 of the permanent form 3 can be inserted into the locking holes 221 on the front surfaces of the support bars 2.

After that, the permanent form 3 is slidingly moved in the transverse direction of the member, so that the protrusions 32 can be locked onto the locking holes 221.

Next, the permanent form 3 is built on the neighboring surface of the member in the same order as shown in FIG. 8A (See FIG. 8B).

At this time, the outer protrusion 34 protruding from the bent corner portion 33 of the permanent form 3 is laid upon top of the other side outermost protrusion 32' of the permanent form 3' coupled to the neighboring member surface.

When the permanent form 3 horizontally slides, as a result, the corner of the member can be finished, without any interference therein.

After that, as shown in FIGS. 8C and 8D, the permanent forms 3 of the remaining surfaces of the member horizontally slide sequentially, and accordingly, the permanent forms 3 can be coupled to the support bars 2, thereby finishing the construction of the permanent forms 3.

FIG. 9 is a perspective view showing a corner stiffener of the combination structure according to the present invention, FIG. 10 is a perspective view showing the permanent form to which the corner stiffeners are coupled in the combination structure according to the present invention, and FIG. 11 is a plan view showing an example where the corner stiffener is adopted in the combination structure according to the present invention.

As shown in FIGS. 9 to 11, corner stiffeners 4 are coupled to the inside of the bent corner portion 33.

If a size of the member is large or a one-time casting height of concrete is high, a substantially strong lateral pressure is applied to the corners of the member.

So as to allow the strong lateral pressure to be stably supported against the corners of the member, accordingly, the corner stiffeners 4 are coupled to the inside of the bent corner portion 33.

The corner stiffeners 4 are spaced apart from each other in the longitudinal direction of the member, and their installation distance is determined according to a one-time casting height of concrete.

Upon concrete casting, on the other hand, air is caught at a lower portion of the corner stiffener 4, so that the concrete is not cast compactedly, and so as to avoid such a problem, accordingly, the corner stiffener 4 desirably has an air hole 41 formed thereon.

Further, the corner stiffener 4 has a first extended portion 42 extended from a protrusion side end portion thereof in such a manner as to surround the protrusion 32 and a second extended portion 43 extended from an outer protrusion side end portion thereof in such a manner as to be inserted into the inside of the outer protrusion 34.

The first extended portion 42 has a shape of a 'L'-like hook, surrounds the protrusion 32, and is then fixed to the protrusion 32 by means of welding W.

At this time, the first extended portion 42 is adapted to surround the protrusion 32, so that the corner stiffener 4 can be rigidly fixed to the protrusion 32 only by means of spot welding.

The second extended portion 43 is lockedly inserted into the inside of the outer protrusion 34.

The second extended portion 43 serves to prevent the bent corner portion 33 from being open outward due to the lateral pressure of the concrete upon the concrete casting.

The protrusion 32' formed on the outermost position of the permanent form 3' of the neighboring member surface is locked onto the outer protrusion 34 supported rigidly against the second extension portion 43 of the corner stiffener 4, so that the protrusion 32' can be stably supported against the outer protrusion 34.

In detail, one end of the permanent form 3 is supported against the corner stiffener 4, and the other end thereof is supported in such a manner as to allow the outermost protrusion 32' to be locked onto the end portion of the permanent form 3' of the neighboring member surface, so that both ends of the permanent form 3 can be supported rigidly.

Since the bent corner portion 33 is reinforced by means of the corner stiffeners 4, moreover, rigid coupling on the corners of the member can be maintained, without any separate corner beads or clips for connecting the permanent forms 3 thereon.

Further, the corner stiffener 4 has support wings 44 bent vertically from sides coming into contact with the bent corner portion 33 in such a manner as to be supported against the surfaces of the bent corner portion 33.

When the corner stiffener 4 is inserted into the bent corner portion 33 and is fixed thereto by means of welding, the support wings 44 are adapted to allow the corner stiffener 4 in position to be fixed to the bent corner portion 33 and to allow a horizontal level of the corner stiffener 4 to be maintained.

The support wings 44 are formed on both of two end portions coming into contact with the bent corner portion 33, so that they can be fixed in position in two directions.

Accordingly, the corner stiffener 4 is fixed rigidly to the bent corner portion 34 by means of the two-directional support of the support wings 44, thereby allowing welding for the corner stiffener 4 to be easily achieved.

INDUSTRIAL APPLICABILITY

According to the present invention, the combination structure of the permanent forms and the prefabricated steel assembly for the steel concrete composite member is capable of easily combining the permanent forms to the prefabricated steel assembly, thereby greatly reducing time and costs required to construct and deconstruct the forms. Further, the combination structure is capable of allowing the support bars to serve as the support frames for the permanent forms, so that thicknesses of the forms can be minimized, thereby giving an economical advantage, and further, the permanent forms can be more lightweight than the existing forms, thereby being easily handled by a worker.

The invention claimed is:

1. A combination structure of permanent forms (3) and a prefabricated steel assembly for a steel concrete composite member, the combination structure comprising:

the prefabricated steel assembly configured to build the steel concrete composite member and having a plurality of shape steel members (1) disposed on corners of the steel concrete composite member in such a manner as to be internally spaced apart from surfaces of the steel concrete composite member and a plurality of support bars (2) coupled to outer surfaces of the shape steel members (1) to connect neighboring shape steel members (1), each support bar (2) having a 'L'-shaped section in such a manner as to allow one side leg (21) thereof to be fixedly coupled to the shape steel members (1); and each permanent form (3) having a flat plate (31) configured to build an outer surface of the steel concrete composite member, protrusions (32) having 'L'-shaped sections in such a manner as to protrude longitudinally from an inner surface of the flat plate (31), a bent corner portion (33) bent vertically from one side end of the flat plate (31) toward a neighboring member surface, and an outer protrusion (34) having a 'L'-shaped section, protruding longitudinally from an inner end of the bent corner portion (33), and laid on top of a protrusion (32') formed on an outermost position of the permanent form (3') coupled to the neighboring member surface, wherein each support bar (2) has a second side leg (22) having 'L'-shaped locking holes (221) whose inlets are larger than widths of the protrusions (32) so as to insertedly lock the protrusions (32) thereinto, wherein corner stiffeners (4) are spaced apart from each other in a longitudinal direction thereof and are coupled to an inside surface of the bent corner portion (33), each corner stiffener (4) having a first extended portion (42) extended from a protrusion side end portion thereof in such a manner as to surround the protrusion (32) and a second extended portion (43) extended from an outer protrusion side end portion thereof in such a manner as to be inserted into an inside section of the outer protrusion (34) and fixed to the bent corner portion (33) by means of welding.

2. The combination structure according to claim 1, wherein the second side leg (22) of each support bar (2) has an extended support (23) extended from one end thereof toward the bent corner portion (33) in such a manner as to be inserted into an inside section of a respective said protrusion (32) so as to support the respective protrusion (32).

3. The combination structure according to claim 1, wherein each corner stiffener (4) has support wings (44) bent vertically from sides coming into contact with the bent corner portion (33) in such a manner as to be supported against the surfaces of the bent corner portion (33).

* * * * *